US005474207A

United States Patent [19]

Nouhra

[11] Patent Number: 5,474,207

[45] Date of Patent: Dec. 12, 1995

[54] LIQUID STORAGE TANK WITH GLASS REINFORCED PLASTIC TIE RODS

[75] Inventor: Raymond N. Nouhra, Lorton, Va.

[73] Assignee: Fiber Technology Corporation, Lorton, Va.

[21] Appl. No.: 265,263

[22] Filed: Jul. 1, 1994

[51] Int. Cl.[6] ..... B65D 7/44

[52] U.S. Cl. ..... 220/653

[58] Field of Search ..... 220/653

[56] References Cited

U.S. PATENT DOCUMENTS

| | | |
|---|---|---|
| 1,686,931 | 10/1928 | Russell . |
| 1,981,568 | 11/1934 | Owen . |
| 3,283,050 | 11/1966 | Boggs . |
| 3,327,883 | 6/1967 | Bühler . |
| 3,368,708 | 2/1968 | Pflederer . |
| 3,739,556 | 6/1973 | Waters . |
| 3,883,031 | 5/1975 | McMillan . |
| 4,050,605 | 9/1977 | Wakana et al. . |
| 4,193,510 | 3/1980 | Weston . |
| 4,307,814 | 12/1981 | Ihira . |
| 4,331,252 | 5/1982 | Carren et al. . |
| 4,756,425 | 7/1988 | Wise . |
| 4,830,409 | 5/1989 | Freeman . |
| 4,838,449 | 6/1989 | Jarnott et al. . |
| 5,050,246 | 9/1991 | Huntoon . |

*Primary Examiner*—Joseph M. Moy
*Attorney, Agent, or Firm*—Stevens, Davis, Miller & Mosher

[57] ABSTRACT

A rectangular liquid storage tank having outer walls made up of bolted together square panels and a plurality of non-metal tie rods extending across the interior of the tank to prevent outward bulging of the tank walls. The non-metal tie rods have corrosion resistant bolts at each end which have a hollow bore with the tie rods adhesively secured therein. The bolts have turnbuckle means for tensioning the tie rods.

21 Claims, 12 Drawing Sheets

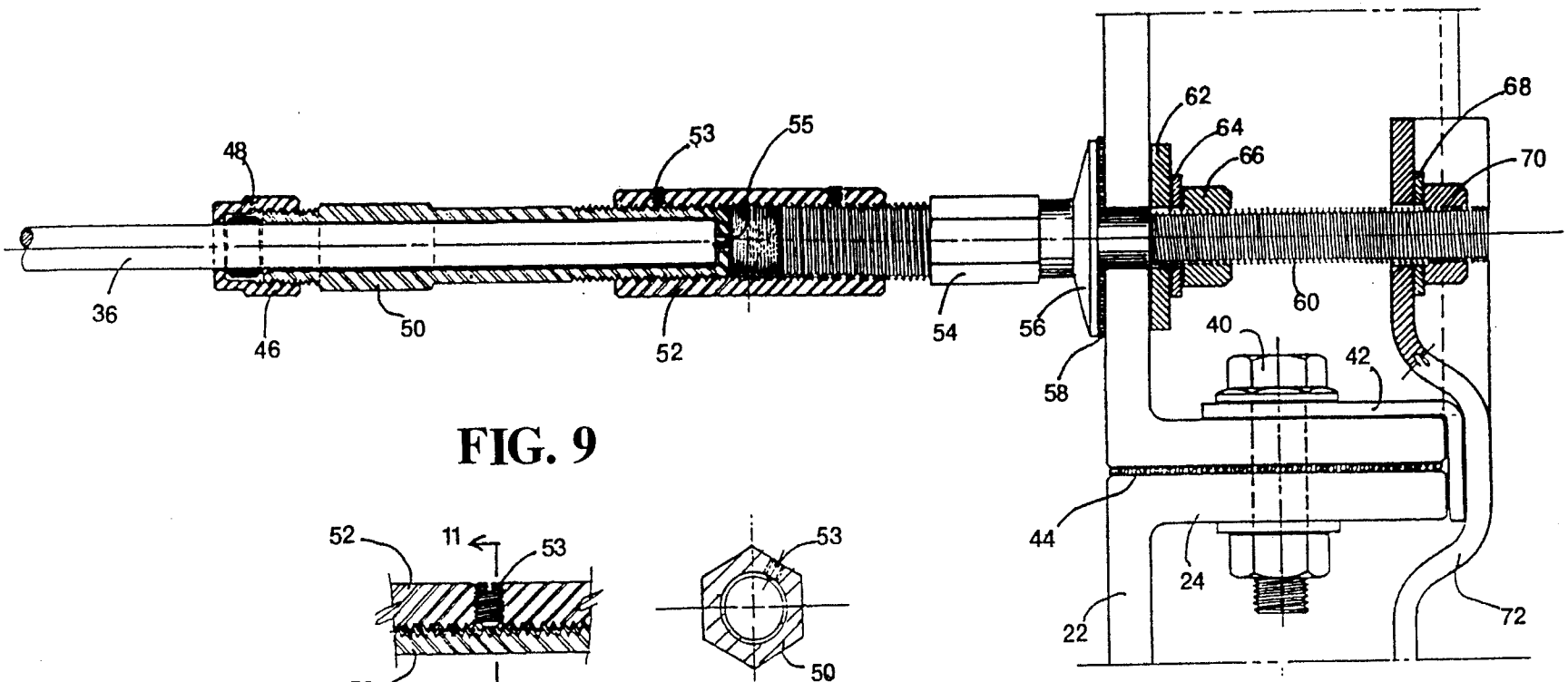
FIG. 9
FIG.11
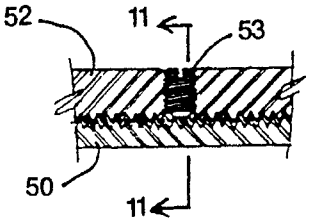
FIG.10

LIQUID STORAGE TANK WITH GLASS REINFORCED PLASTIC TIE RODS

BACKGROUND OF THE INVENTION

It is known in the prior art to construct large rectangular liquid storage tanks which are made by assembling together a plurality of square plastic panels. These panels usually have peripheral flanges shaped to interfit with each other and with a gasket or elastomer material at the interfitting flanges to prevent leakage.

Two principal uses for such large tanks are: (a) on the roofs of buildings to hold water for fire protection or to insure uniform water pressure in the plumbing system of the building and (b) for storage of water in dry climates where an adequate supply of rain water and/or well water may not be available for much of the year.

In particular, this invention is directed to an improvement in large panel type water storage tank such as that disclosed in Wakana et al U.S. Pat. No. 4,050,605 (assigned to Bridgestone Tire Company Limited of Tokyo, Japan), the entire disclosure of which is hereby incorporated by reference and will be referred to hereinafter as "Wakana et al".

In the Wakana et al patent, long metal tie rods extend across the tank to prevent the sidewalls of the tank from bulging outwardly due to the pressure exerted by the water in the tank when it is full or partly full.

Experience has shown that such metal tie rods (usually stainless steel) do not work out well in practice due at least partly to (a) unequal coefficients of expansion between the non-metal glass reinforced plastic (GRP) panels and the metal tie rods and (b) corrosion of the stainless steel fittings, particularly where welded.

SUMMARY OF THE INVENTION

It is an object of the present invention to ensure greater stability, longer service life and reduced cost of GRP panel tanks by use of tie rods having a coefficient of expansion similar to that of the panels.

It is a further object of the present invention to prevent corrosion of tie rod fittings by use of corrosion resistant metals such as forged bronze fittings secured to the ends of the tie rods.

Another objective is to avoid welding of metal parts which can lead to corrosion or stress points.

Further objectives and advantages will become apparent to those skilled in the related art by study of the following drawings and specification.

Figure 2:
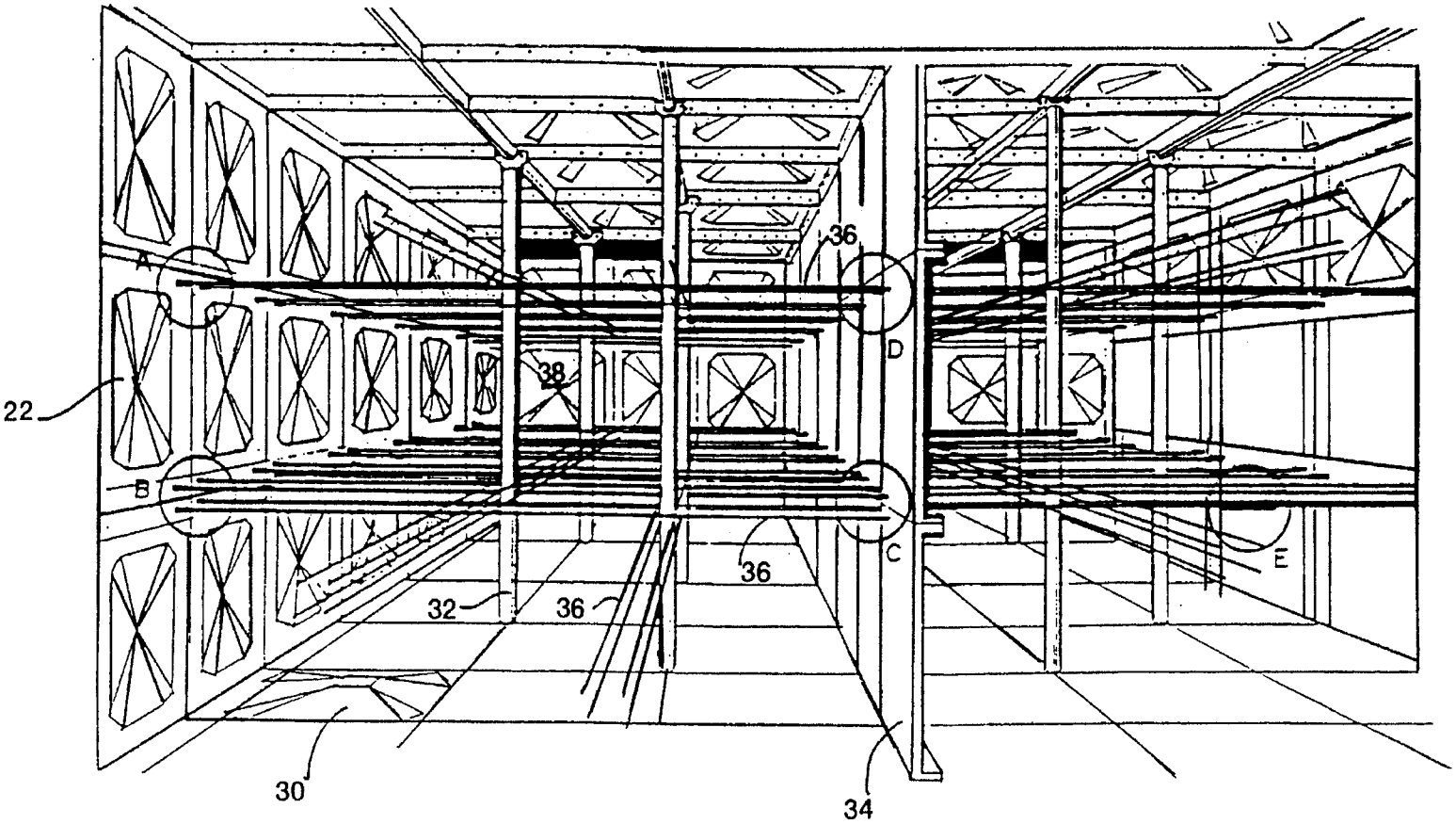
FIG. 2 is a perspective elevational view of the interior of a water tank with one side removed to facilitate viewing of the interior and showing the left wall and a center partition; encircled portions are shown in greater detail in subsequent figures.
Figure 3:
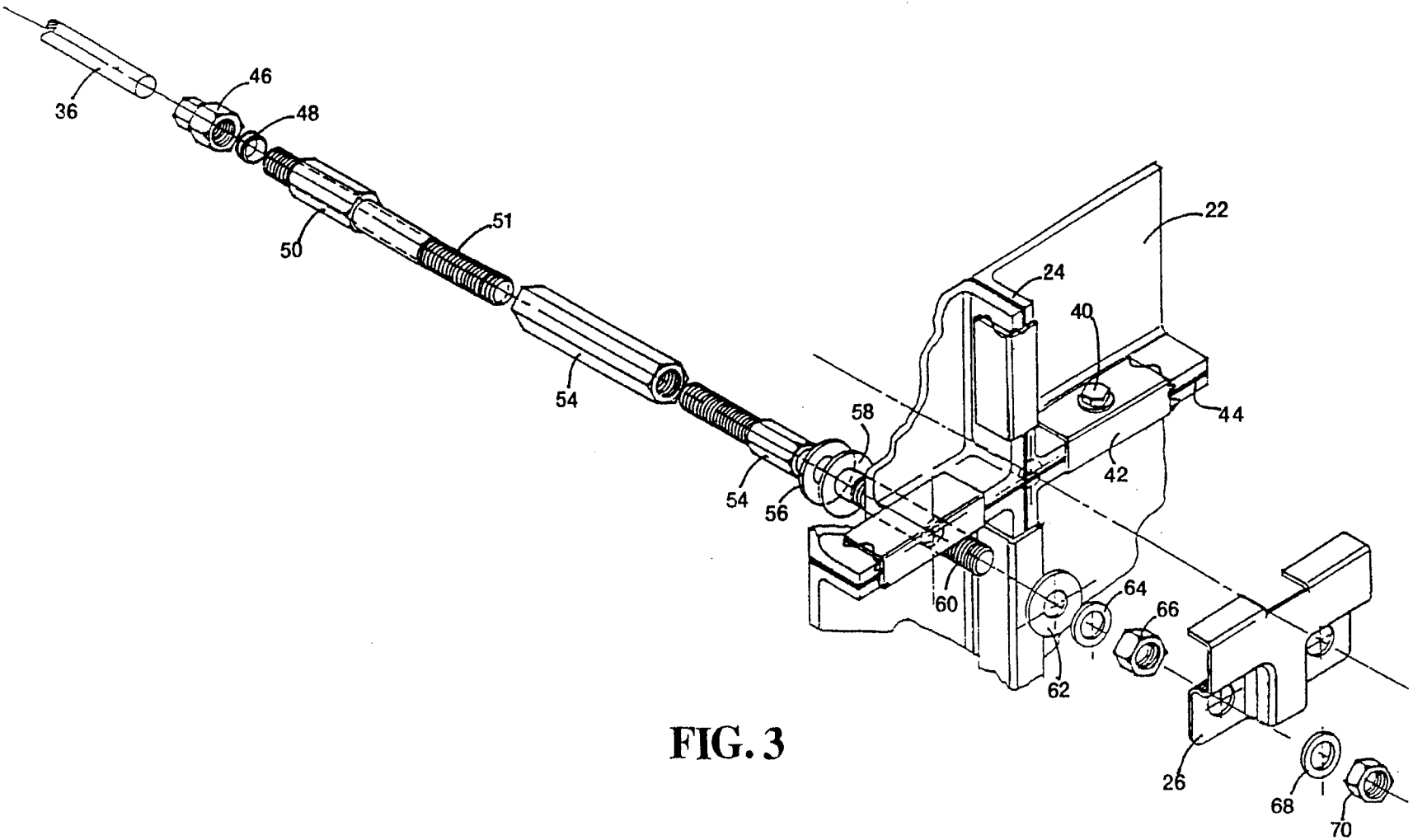
Figure 4:
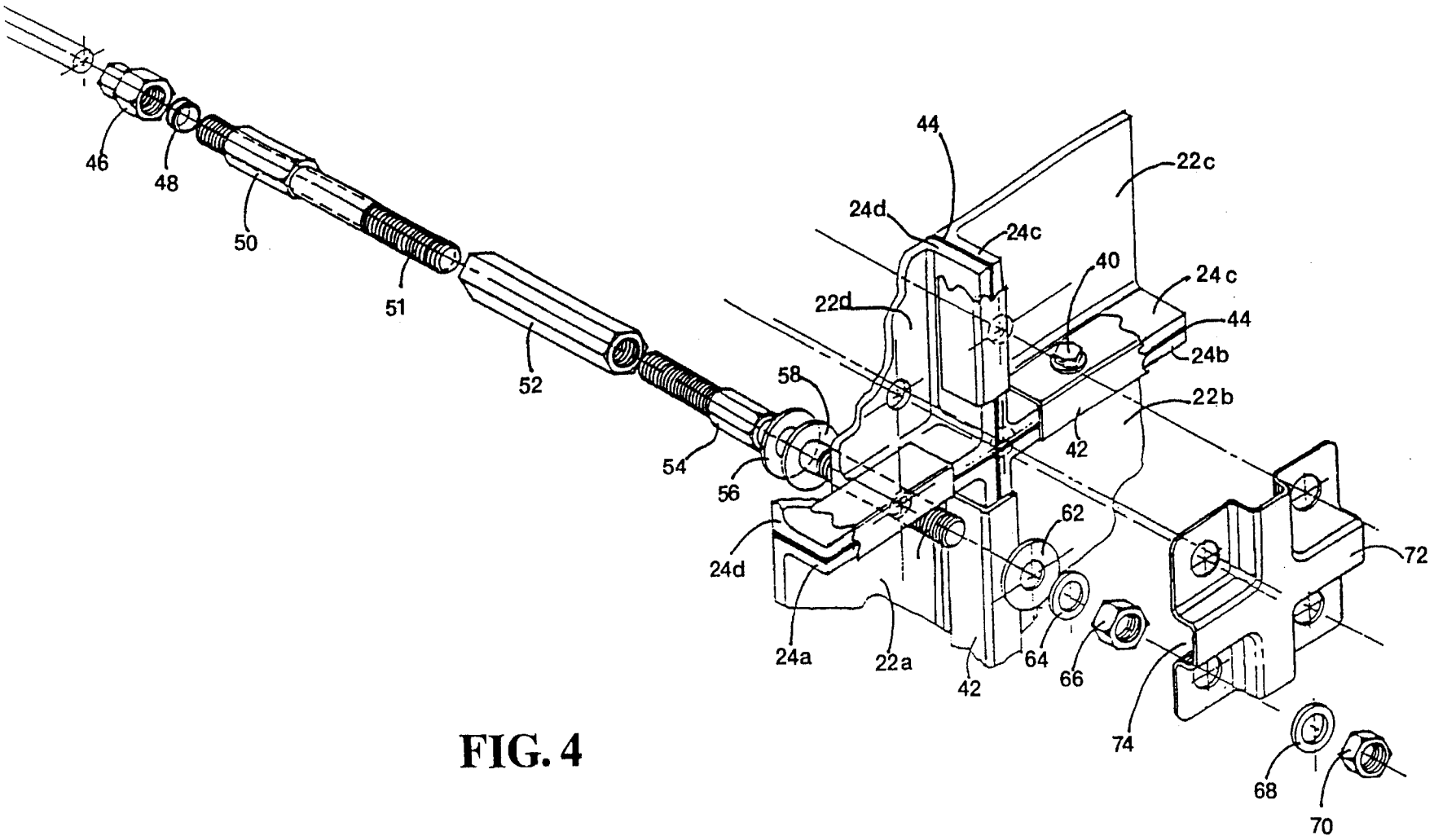
Figure 5:
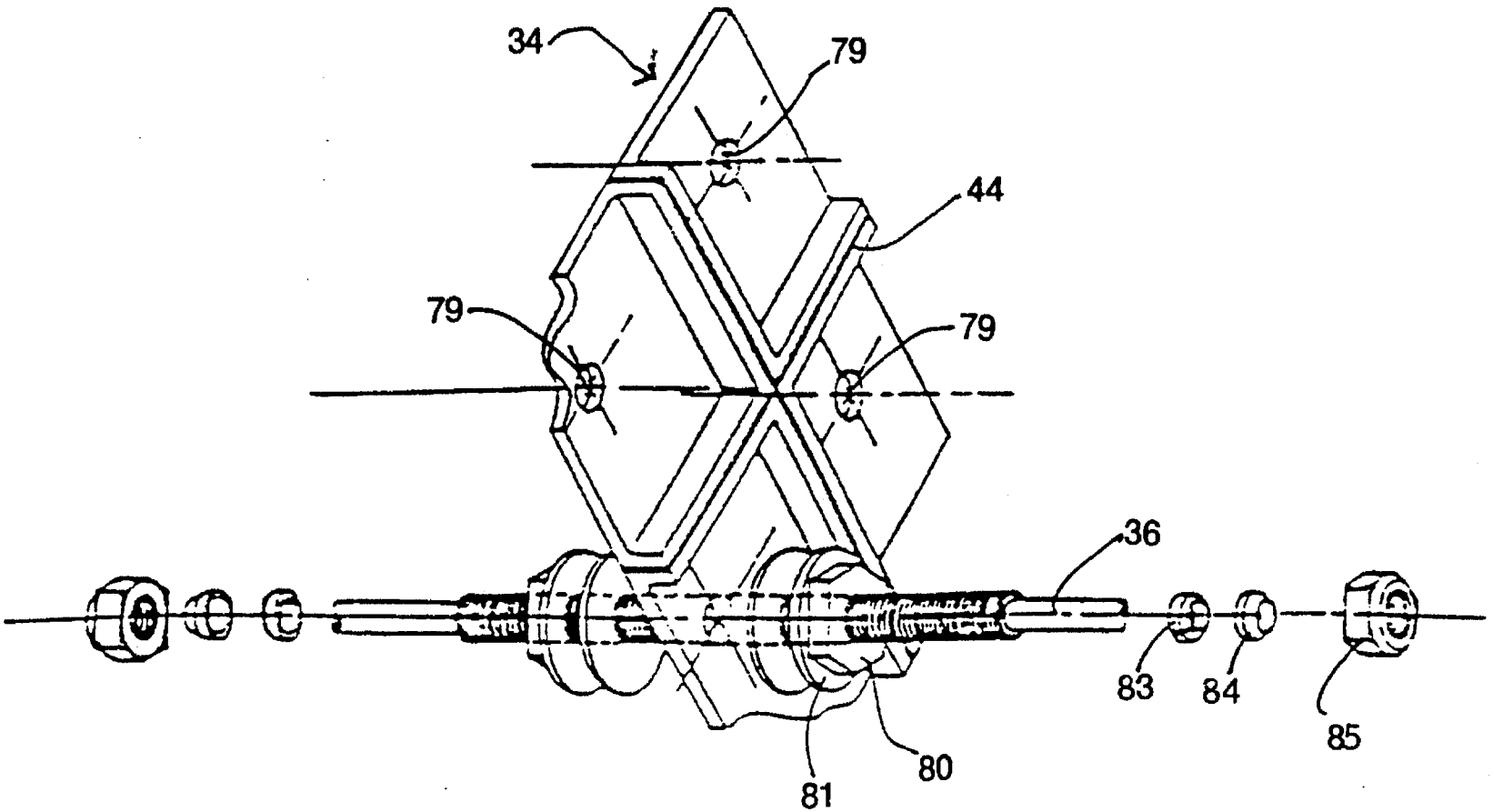
Figure 6:
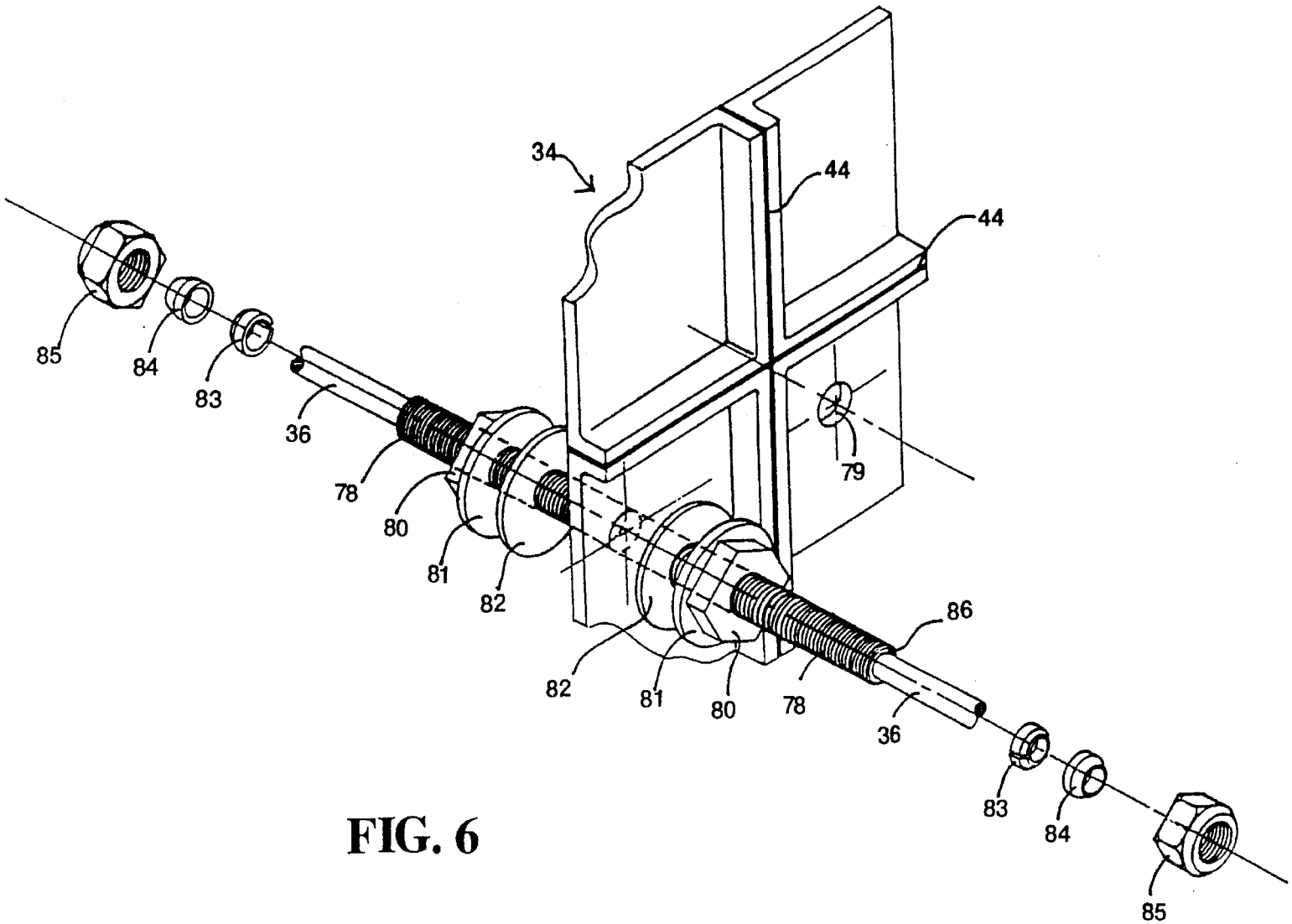
Figure 7:
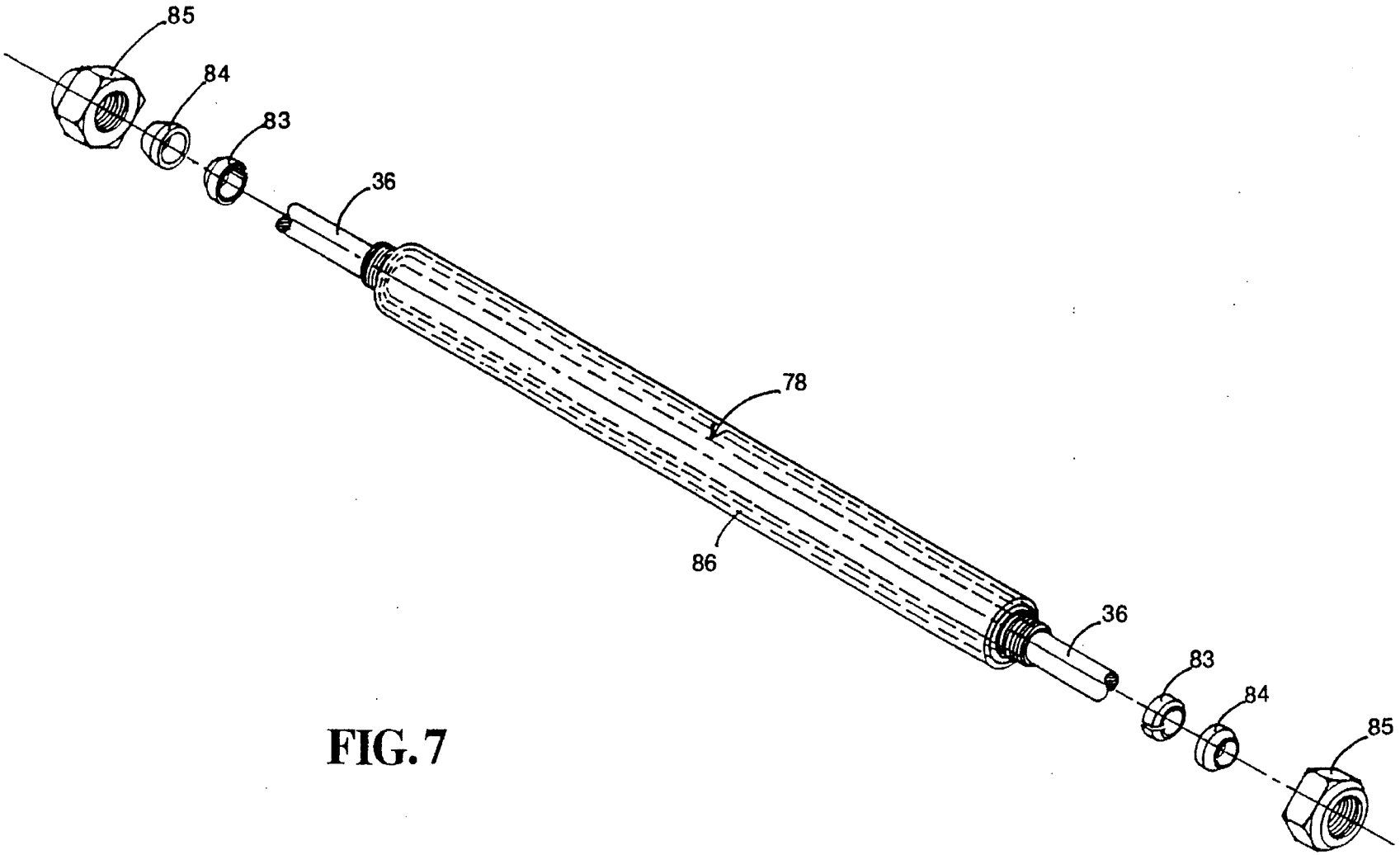
Figure 8:
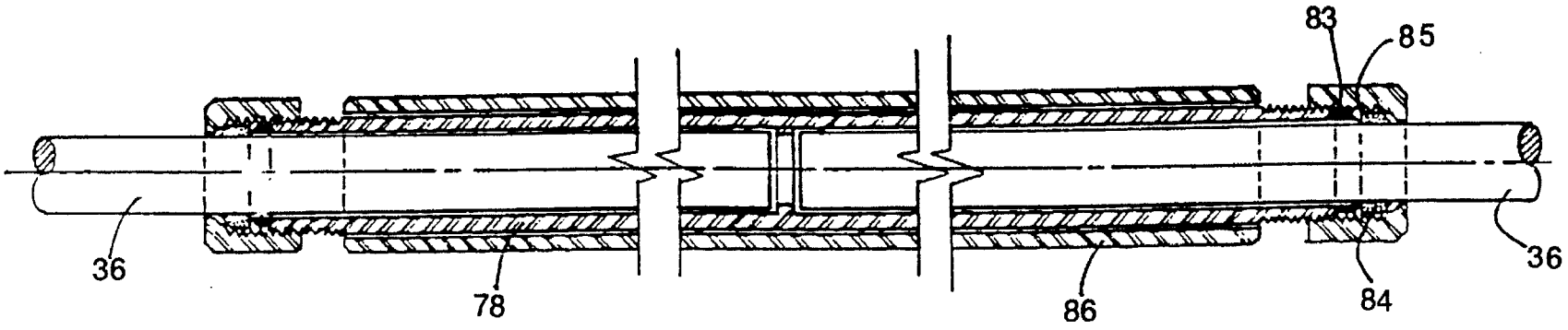
Figure 12:
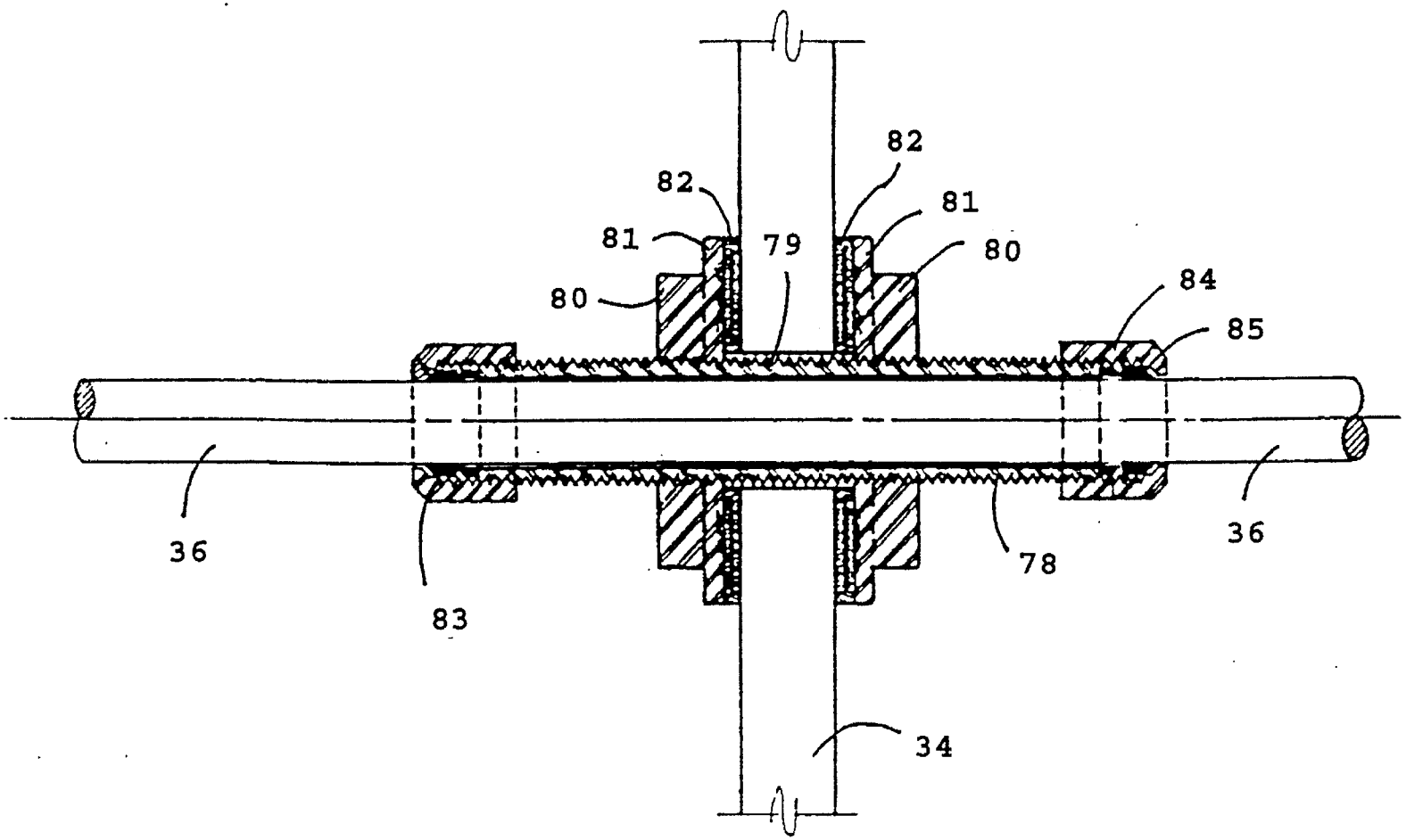
Figure 13:
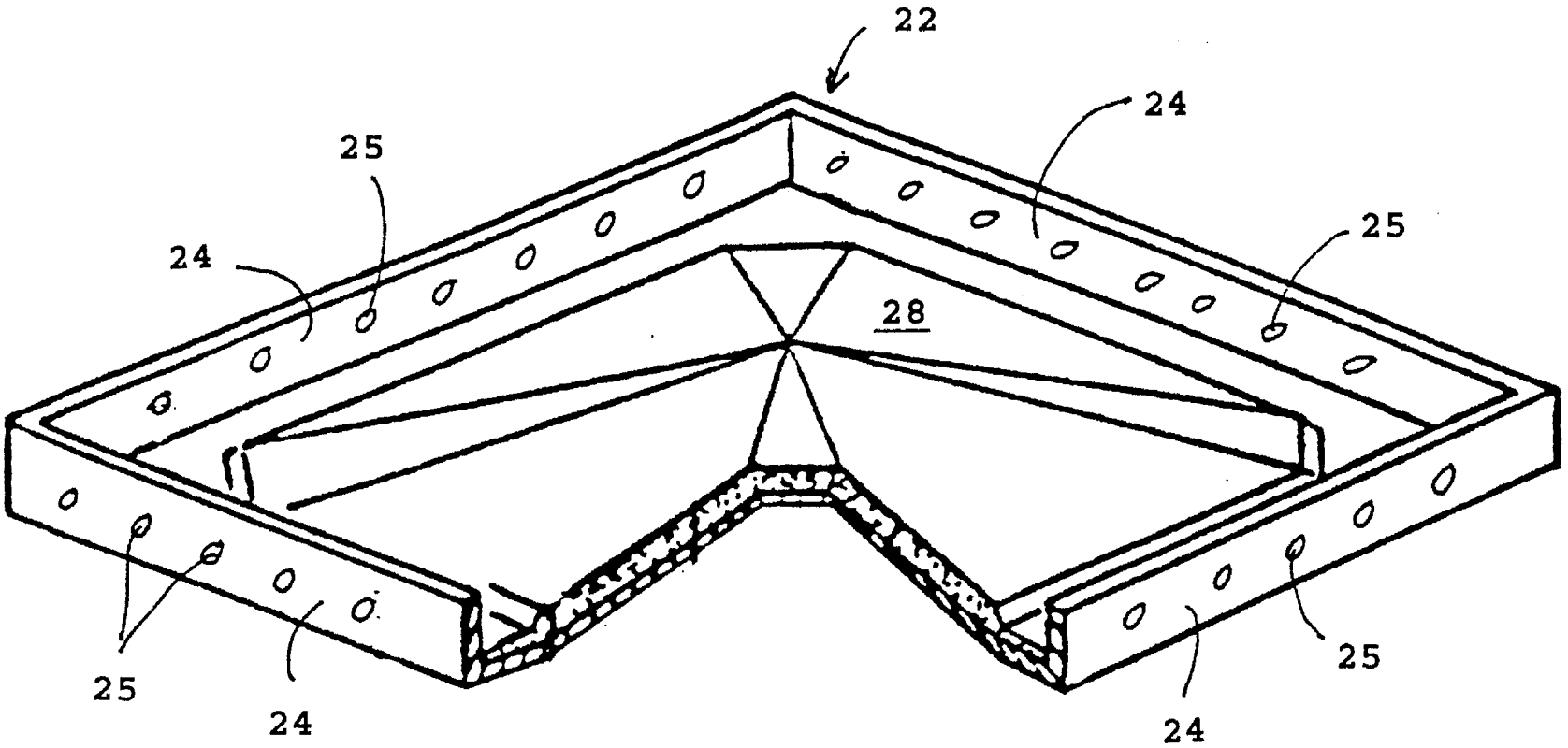
Figure 14:
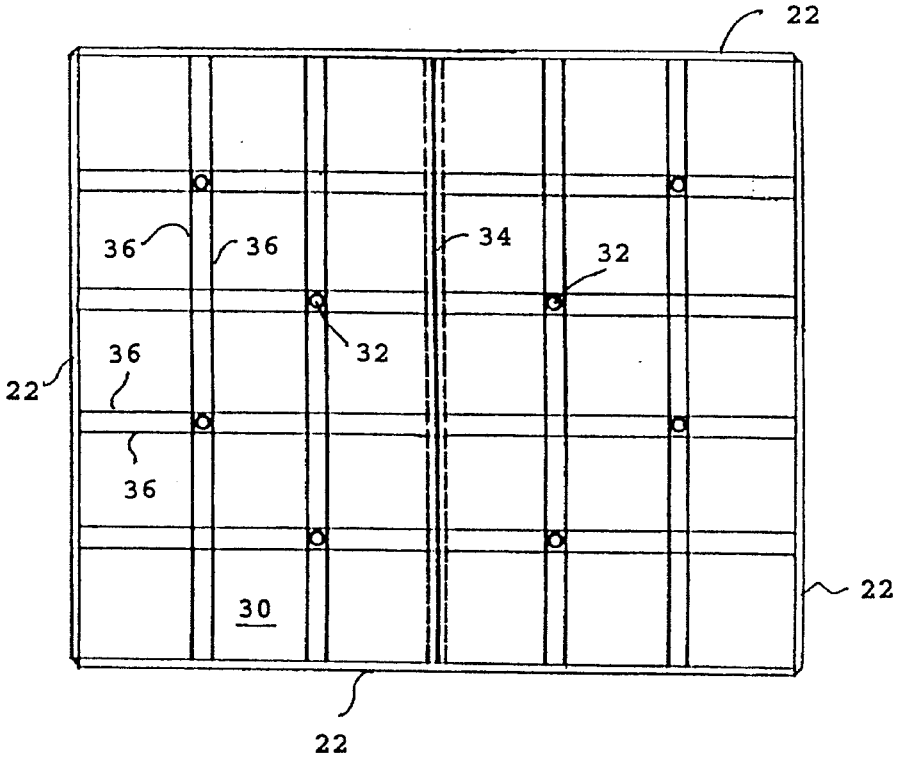
Figure 15:
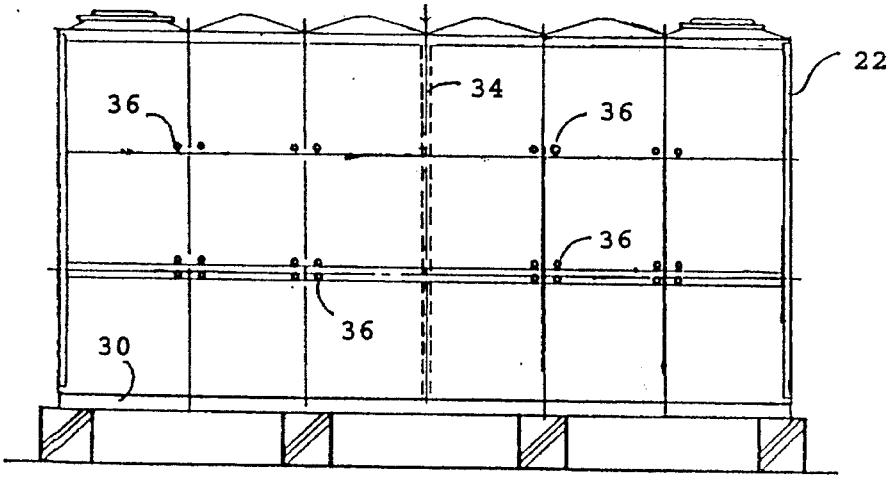

detail A of FIG. 2 is shown in FIG. 3;

detail B of FIG. 2 is shown in FIG. 4;

detail C of FIG. 2 is shown in FIG. 5;

detail D of FIG. 2 is shown in FIG. 6;

detail E of FIG. 2 is shown in FIG. 7;

FIG. 3 is a perspective exploded detail view of an upper level tie rod attachment to an outer tank wall;

FIG. 4 is a perspective exploded detail view of a lower level tie rod attachment to an outer tank wall;

FIG. 5 is a perspective exploded detail view of a lower level partition tie rod connection through an interior partition wall;

FIG. 6 is a perspective exploded detail view of an upper level wall tie rod connection through a partition wall;

FIG. 7 is a perspective exploded detail view of a tie rod coupling according to the present invention;

FIG. 8 is a longitudinal sectional view through the tie rod coupling of FIG. 7;

FIG. 9 is an assembled longitudinal sectional view of a tie rod connector similar to that shown in exploded view in FIG. 4;

FIG. 10 is an enlarged view of a portion of FIG. 9;

FIG. 11 is a sectional view along line 11—11 of FIG. 10;

FIG. 12 is a longitudinal section view of a tie rod interior partition connector such as shown in FIG. 5 or FIG. 6 but in installed position on a partition wall;

FIG. 13 is a perspective view of a typical tank panel shown partly in section to illustrate the cross section thereof;

FIG. 14 is a schematic plan view of an assembled tank showing the positioning of the tie rods extending horizontally across the interior of the tank at one level thereof;

FIG. 15 is a schematic elevational cross sectional view of an assembled tank shown the positioning of the tie rods in relation to the panels thereof.

DETAILED DESCRIPTION OF THE INVENTION

Figure 1:
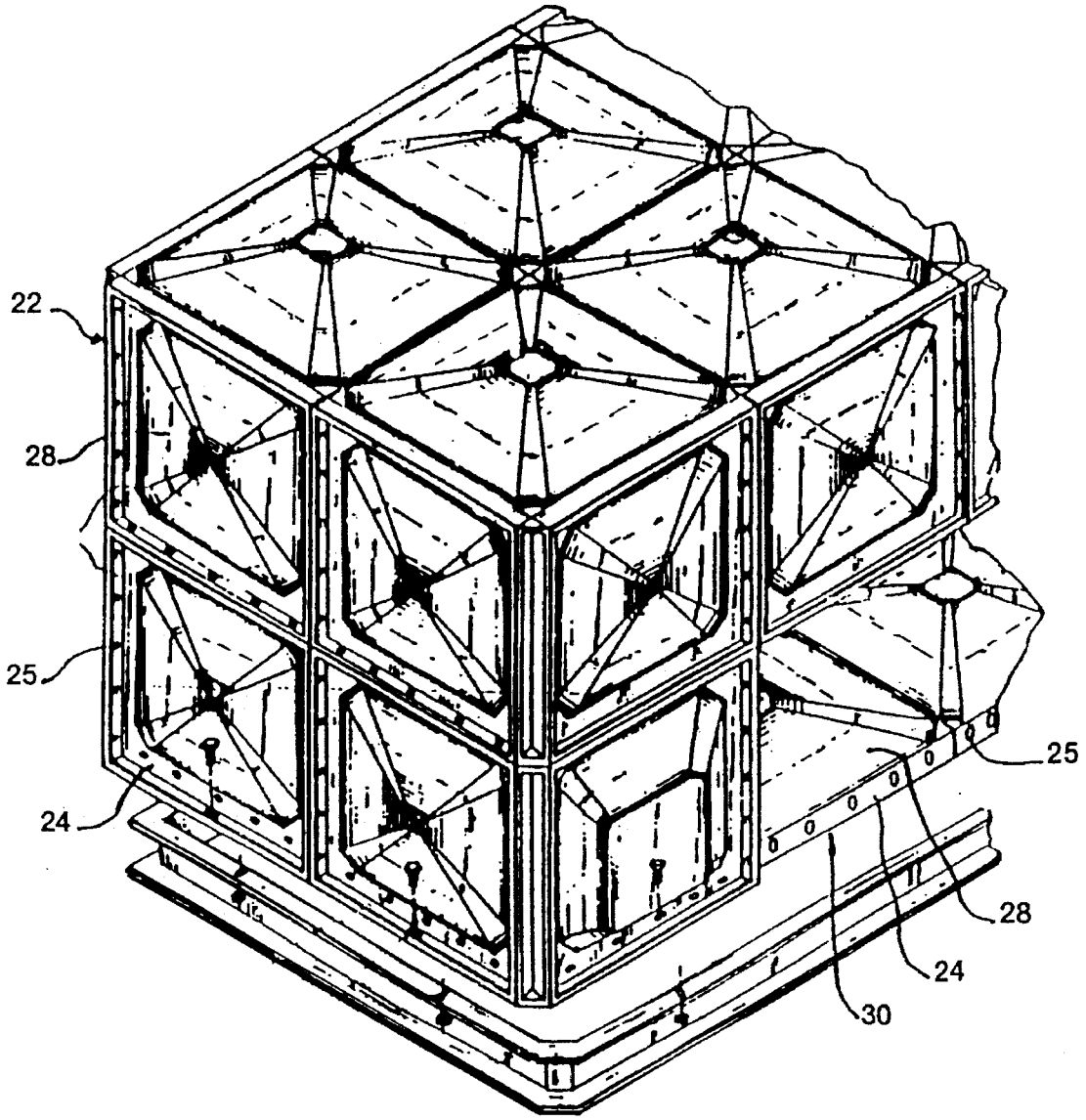
FIG. 1 PRIOR ART
FIG. 1 is a perspective view of prior art water tank made of a plurality of similar size panels of glass fiber reinforced plastic (GRP)

FIG. 1 is a perspective view of a portion of a typical assembled prior art tank comprising a plurality of sidewall panels 22, each being about one meter square with each edge having outwardly turned panel flange 24 (see FIG. 13), the flanges having a plurality of holes 25 for insertion of fastening means such as bolts. Thus during assembly as adjacent panels are placed in side-to-side contact the holes 25 of flanges 24 are spaced to be in alignment so that bolts can be inserted to hold the panels in position.

Bottom wall panels 30 are similarly bolted by their flanges to the bottom flanges 24 of the lower row of side panels 22. Each of the side panels 22 preferably has an outwardly extending pyramidal protrusion 28 for strengthening the panel. The bottom panels 30 have a similar protrusion which preferably extend inwardly into the tank and also serve to channel water for complete emptying when the tank is drained.

The foregoing panels, flanges and protrusions are discussed in greater detail in Wakana et al patent and are of similar construction here and thus do not need to be disclosed in detail.

As is known in the art, the sidewalls of any liquid storage tank must bear a considerable amount of outwardly directed pressure, with the pressure on any particular location being directly proportional to the height of the column of liquid standing above it. In a storage tank according to the invention the sidewalls may be 3 or 4 meters tall (or even taller in some cases) and thus there is a tremendous amount of outwardly directed pressure on the bottom and sidewalls adjacent the bottom. As is known in the art, one way of strengthening the sidewalls is to extend elongated tie rods across the interior of the tank from one sidewall to an adjacent or opposite sidewall. Thus, as shown in FIG. 14, there may be a reticular pattern of tie rods which extend in parallel across the interior of the tank. As previously stated, the prior art utilized tie rods made of a metal, such as stainless steel, which has a coefficient of thermal expansion which is much greater than the coefficient of thermal expansion of the resin glass fiber GRP panels.

FIG. 2 is an overall perspective elevational view of the interior of a water tank constructed according to the invention. On the left side is an exterior wall made of a plurality of panels 22, in this case three panels high, a partition wall 34 and a first plurality of tie rods 36 which extend horizontally across the interior of the tank, through the partition wall 34 and are secured to the opposed exterior tank wall on the right side of the drawing. A plurality of vertical support posts 32 preferably made of a non-corrosive material such as polyvinylchloride (PVC) extend from the bottom wall 30 to support the top wall of the tank. These posts are spaced so as to be clear of the tie rods 36. There are, of course, a second plurality of tie rods which extend horizontally at right angles to the first plurality of tie rods, the second plurality of tie rods extending from the front wall (not shown) to the back wall 38.

In FIG. 2 there are five encircled areas labelled A, B, C, D and E which involve various aspects of the tie rods 36 which are respectively illustrated in detail in FIGS. 3–7.

As previously mentioned, there is considerably more outward stress on the sidewall panels 22 at the lower levels of the tank. Therefore, as shown in FIG. 2, when a tank is three or more panels high, in order to avoid bulging of the sidewalls, at the lower level of panels 22 at each area where four panels meet, there are four separate tie rods extending from that area, one for each panel as shown at point B in FIG. 2 and as illustrated in FIG. 4. In a smaller tank, say only 2 panels high, one may use a smaller number of tie rods. The number depends upon the strength of the tie rod and associated fittings. At the upper levels of the tank, say at the area of the lower edge of the top panel, a smaller number of tie rods can be used; usually 2 or 3. Tie rods for the top panel can usually be omitted.

Turning to FIG. 4 in greater detail, there is shown the junction area of four sidewall panels 22A, 22B, 22C and 22D, each being similarly shaped with a flange 24A–24D, the flanges being secured together by fastening means such as bolts 40, only one of which is shown but it being understood that there is a plurality of bolts and nuts, usually eight on each edge of a panel, and spaced around each panel flange with each bolt passing through an "L" shaped reinforcing bar 42 to stiffen the joints and reinforce the whole tank in its most stressed regions and to spread the compressive force of the bolt over the surface of the flange 24. Between adjacent flanges e.g. flanges 24B and 24C, there is a sealing strip 44. The "L" shaped reinforcing bars 42 preferably extend along the entire length of each flange.

GRP tie rod 36 is secured inside a hollowed tubular portion of double-threaded bolt 50 and glued therein by an appropriate high strength epoxy adhesive, one example being Ciba-Geigy epoxy AW139 resin and HV998 hardener. Rod 36 is initially held in place and the annular space at the end of hollow tubular bolt 50 is sealed by a cap nut 46 threaded onto the end of bolt 50 and compressing a brass ring 48 inside the nut 46. This end of the double threaded bolt 50 is a right hand thread and the opposite end 51 is a left hand thread. As shown in FIG. 4, coupling 52 has a left hand threaded female end facing male end 51 and a right hand threaded female end facing the left male end of attachment bolt 54. Thus when coupling 52 is rotated, it acts as a turnbuckle to increase or decrease the tension on tie rod 36. To facilitate such turning bolts 50 and 54 and coupling 52 have a non-round wrench gripping area, which is preferably hexagonal in cross-section as shown in FIG. 11.

The construction of attachment bolt 54 represents an important aspect of the present invention. Bolt 54 is made of a corrosion resistant material with a washer 56 (which is trapezoidal in longitudinal cross-section) which is an integral part of the bolt 54, that is, washer 56 is not welded or brazed to bolt 54, it is a part of the bolt itself, thus avoiding a difficulty in the prior art where welding or brazing could establish an area of weakness subject to corrosion or breakage.

Washer 56 is formed by working of the material of the connector 54 for example by forging the connector 56 during its manufacture so as to locally expand the diameter of the connector in the area where washer 56 is to be located. After being enlarged, the ends may then have threads formed thereon in a separate operation. Thus washer 56 is an integral part of bolt 54.

In the present context the term "corrosion resistant material" refers to a material which will have no chemical reaction or a minimum chemical reaction with liquid stored in the tank. Usually this liquid is water but, as is well known, the pH of water varies widely depending upon its source; thus the type of corrosion resistant material used in a water tank in one location may not be suitable in another location. Usually metals and particularly copper alloys of various types, particularly bronzes, which constitute a large family of metals, are desirable as are some types of stainless steels which can be worked as needed to form the connector in the desired shape. It is also contemplated that the corrosion resistant material may be a non-metal such as a high strength composite.

The threaded end 60 of bolt 54 passes through a hole in panel 22 and is sealed against leakage by washer 56 and a rubber gasket 58 on the tank interior. On the tank exterior is a large washer 62, a smaller washer 64 and an inner nut 66. Washers 56 and 62 are of the same large size for better distribution of compressive bolt force on the panel exterior. After all four bolts 54 are in place and the rubber gaskets are secured in place so as to prevent tank leakage, then a square plate 72 having a cross shaped recess 74 is placed over the four bolts ends 60 and held in place by four nuts 70 and washers 68 thereunder.

The assembled arrangement is shown in FIG. 9, it being understood that at the corner of four panels of the lower row of panels and the panels thereabove (point B in FIG. 2) there are preferably four tie rods 36 and thus four inner nuts 66 and four outer nuts 70, whereas on an upper panel (point A in FIG. 2) there are preferably two inner nuts and two outer nuts. The purpose of the inner nuts 66 is to insure that the gaskets 58 and large washers 62 sealingly engage the inner and outer surfaces of the panel 22 whereas the purpose of the outer nuts 70 against square plate 72 is to carry the stress of panels being pushed outwardly by the liquid contents of the tank. The purpose of the coupling 52 is to act as a turnbuckle to adjust the tension between adjacent tie rods so the tension is evenly distributed therebetween.

FIG. 10 shows a portion of coupling 52 to illustrate that a set screw 53 is used in each end of the coupling to engage the threads of the double threaded bolt 50 and the threads of the attachment bolt 50 to maintain the coupling in place after tensioning of the tie rod. FIG. 11 is a view along line 11—11 of FIG. 10 showing the hexagonal shape of the coupling 52.

FIG. 3 shows the tie rod end connections for point A in

FIG. 2, that is where two rather than four tie rods 36 are connected into the panels. In that instance, square plate 72 is replaced by rectangular plate 26 having a "T" shaped recess therein which fits over three rather than all four of the flanges of the joint.

FIG. 6 shows the manner in which the tie rod 36 passes through partition 34 with the assembled connection being shown in FIG. 12. A connector body 78 in the form of a hollow brass pipe having exterior threads has a tie rod 36 passing therethrough and being held therein by an epoxy adhesive 86 similar to that previously described. The tie rod 36 is held centered in body 78 during setting of the adhesive and is also sealed on each end against entry of water into body 78 by means of a brass ring 83, a rubber ring 84 and a brass cap nut 85 which is threaded onto each end of connector body 78 which passes through a hole 79 in the partition 34. The connector body 78 is secured in place in hole 79 on each side of partition 34 by means of a hex nut 80 with washer 81 and rubber coated washer 82. Thus by tightening nuts 80 when the partition 34 is in proper position (planar and vertical) the interior of the tank may be divided into two compartments which are effectively sealed off from each other. Securing body 78 to the tie rod 36 and the panel 34 leads to a strengthened tank in which the tie rods are supported against vertical and side-to-side movement by the partition and at the same time the partition 34 is held in proper vertical alignment so that the tank roof and floor are tied together to rigidify the entire structure. As with the sidewalls, the flanges of the panels of the partition 34 have a sealing strip 44 therebetween but the partition panels do not necessarily have pyramidal protrusions 28 as on the sidewall panels.

FIGS. 7 and 8 illustrate (in perspective and longitudinal cross-section respectively) a tie rod coupling 78 which, as shown in point E in FIG. 2, is used to splice together the ends of two tie rods so as to act as a single continuous tie rod. The structure of the coupling 78 is very similar to that of the partition connector as described above except that it is not threaded along its entire exterior surface. It comprises a body, with two threaded ends, each end having a cap nut 85 which compresses rubber ring 84 and brass ring 83. The two tie rod ends which are to be spliced together each extend to about the center of the body and are held in place by the same sort of high strength epoxy adhesive as previously described so as to maintain the tensile strength of the two rods as though they were originally integrally attached. The exterior of coupling 78 is covered by a GRP sleeve 86 so as to minimize the metal surface exposed to potential corrosion by the water in the tank.

In one preferred embodiment of the invention, the GRP tie rods were 10 mm in diameter and the inside diameter of the bore of bolt 50 or coupling 78 was 10.4 to 10.50 mm, thus leaving an annular space for adhesive around the tie rod, when inserted into the bolt or coupling, of about 0.2 to 0.25 mm. When the hollow inside of the bolt 50 or coupling 78 is formed, such as by drilling, it is preferable that the inside walls not be smoothly finished but instead left somewhat rough to furnish a good adhesion surface for the adhesive. It is also preferable that a vent hole 55 be left in the interior end of bolt 50 for exit of air (and perhaps excess adhesive) when the adhesive coated end of the tie rod is pushed into the open body of the bolt. To insure adequate strength of the connection between tie rod 36 and bolt 50, it is preferable that the ratio between the diameter of the tie rod 36 and the length of the adhesive joint within the hollow body of the bolt be greater than 4:1 and more preferably greater than 6:1. Thus a 10 mm tie rod would extend at least 40 to 60 mm into the bolt 50 or coupling 78. There are many non-corrosive metals from which the bolt or coupling could be made, one being UNSC 22,000 Bronze.

I claim:

1. A liquid storage tank having a plurality of generally planar sidewalls, each wall made up of a plurality of modular wall non-metallic panels, each panel having a peripheral flange secured to a flange of an adjacent panel and tie rod means extending from one wall to another wall for strengthening said sidewall to prevent bulging thereof due to the outward pressure of the liquid in the tank, said tie rod means comprising an elongate non-metal rod having a connector means at each end, said connector means comprising a first end of tubular elongate form having a bore to receive an end of said non-metal rod, an adhesive within said bore to secure the tie rod end therein, and a threaded second end on said connector means for engagement with one of said panels.

2. The tank of claim 1 wherein said non-metal rod is glass reinforced plastic.

3. The tank of claim 1 wherein said connector body is a corrosion resistant material.

4. The tank of claim 3 wherein the corrosion resistant material is bronze.

5. The tank of claim 1 wherein said connector body is made of a corrosion resistant material which has been formed to have an integral radially outwardly extending tapered flange adjacent one end thereof.

6. The tank of claim 1 wherein the bore of said connector means has an inner diameter which is about 0.4 mm to 0.5 mm larger than an outside diameter of said non-metal tie rod to define an annular space for adhesive when said rod is within said bore.

7. The tank of claim 6 wherein said bore has a length which is at least four times greater than a diameter of said non-metal rod.

8. The tank of claim 1 wherein the second end on said connector means is a male threaded end for projection through an opening in a panel for a nut to be threaded thereon.

9. The tank of claim 8 including liquid sealing gaskets on said second end on inner and outer surfaces of said panel and plate means between said male thread end and said panel for engaging an adjacent flange of said panel.

10. The tank of claim 1 including means for splicing together two portions of said non-metal rod at a point between said connector means, said splicing means comprising a body of tubular elongate form having two ends which are open to receive an end of a non-metal rod and a hollow interior portion of a size and shape to secure said two ends with an adhesive within said interior portion.

11. The tank of claim 10 wherein said non-metal rod is glass reinforced plastic.

12. The tank of claim 10 wherein said connector body is a corrosion resistant metal.

13. The tank of claim 10 wherein said connector body is made of a corrosion resistant metal which has been formed to have an integral radially outwardly extending tapered flange adjacent one end thereof.

14. The tank of claim 10 wherein the bore of said connector means has an inner diameter which is about 0.4 mm to 0.5 mm larger than an outside diameter of said non-metal tie rod to define an annular space for adhesive when said rod is within said bore.

15. The tank of claim 10 wherein said bore has a length which is at least four times greater than a diameter of said non-metal rod.

16. The tank of claim 10 wherein the tubular elongate body of the splicing means has an exterior thread at each end with sealing nuts threaded thereon.

17. The tank of claim 16 including annular rubber seals and annular brass sealing rings positioned to be compressed by tightening of said sealing nuts.

18. The tank of claim 16 including an annular sleeve of non-metallic material positioned over said body between said sealing nuts.

19. The tank of claim 1 including at least one generally vertically extending partition wall within said tank positioned so that some of said non-metal tie rods means pass therethrough and partition connector means on said tie rods which pass therethrough, said partition connector means comprising a body of tubular elongate form having two open ends for a non-metal rod to pass therethrough, threads on the exterior surface of said body and nuts threaded on said body for positioning on opposite side of said partition, an adhesive between the non-metal rod and an interior of said body.

20. The tank of claim 1 wherein said connector means includes a turnbuckle means for adjusting the tension on said tie rod.

21. A liquid storage tank having a plurality of generally planar sidewalls, each wall made up of a plurality of modular wall non-metallic panels, each panel having a peripheral flange secured to a flange of an adjacent panel and tie rod means extending from one wall to another wall for strengthening said sidewall to prevent bulging thereof due to the outward pressure of the liquid in the tank, said tie rod means comprising an elongate non-metal rod having a corrosion resistant metal connector means at each end, said connector means comprising a first end of tubular elongate form having a bore of a diameter of about 0.4 to 0.5 mm greater than a diameter of said non-metal rod to receive an end of said non-metal rod and define an annular space therearound, an adhesive within said annular space to secure the tie rod end in said bore;

a threaded second end on said connector means for engagement with one of said panels;

an integral washer formed on said connector means adjacent said second threaded end for positioning inside an inside surface of said panel.

* * * * *